US007404740B1

(12) United States Patent
Chen

(10) Patent No.: US 7,404,740 B1
(45) Date of Patent: Jul. 29, 2008

(54) FEMALE CONNECTOR

(75) Inventor: Ying-Chung Chen, Pan Chiao (TW)

(73) Assignee: Chief Land Electronic Co., Ltd., Taipei Hsien (TW)

( * ) Notice: Subject to any disclaimer, the term of this patent is extended or adjusted under 35 U.S.C. 154(b) by 0 days.

(21) Appl. No.: 11/947,794

(22) Filed: Nov. 30, 2007

(51) Int. Cl.
*H01R 13/648* (2006.01)

(52) U.S. Cl. ..... 439/608; 439/352; 439/638

(58) Field of Classification Search ..... 439/352–358, 439/608, 638
See application file for complete search history.

(56) References Cited

U.S. PATENT DOCUMENTS 5,620,340 A * 4/1997 Andrews ..... 439/608
5,645,436 A * 7/1997 Shimizu et al. ..... 439/108
5,651,685 A * 7/1997 Brinkman et al. ..... 439/79
5,667,389 A * 9/1997 Kidd et al. ..... 439/75
5,668,698 A * 9/1997 Jozwiak et al. ..... 361/752
5,791,922 A * 8/1998 Takata et al. ..... 439/188
6,602,095 B2 * 8/2003 Astbury et al. ..... 439/608
2002/0098738 A1 * 7/2002 Astbury et al. ..... 439/608
2002/0111069 A1 * 8/2002 Astbury et al. ..... 439/608

* cited by examiner

*Primary Examiner*—James Harvey

(57) ABSTRACT

A female connector that is easy to be engaged with a male connector includes a connector insulator and a plurality of terminal modules inserted into the connector insulator. The terminal module includes grounding pins and fork-shaped signal pins. The signal pin has twisted pin arms and a raised arm portion. The connector insulator includes grounding terminal openings and signal terminal openings. The signal terminal opening includes a raised opening bottom, which has a slope portion and a raised portion. The twisted pin arms provide smooth surfaces to allow a signal terminal of a male connector being smoothly inserted between the pin arms. The raised arm portion, the slope portion and the raised portion allow the two pin arms keeping a distance away from each other.

3 Claims, 11 Drawing Sheets

FEMALE CONNECTOR

BACKGROUND OF THE INVENTION

1. Field of the Invention

The present invention relates to an electrical connector, and in particular to a female connector that is easy to be engaged with a male connector.

2. The Prior Arts

Referring to FIGS. 1 and 2, a conventional connector includes a male conductor 14 and a female conductor. The female connector includes a connector insulator 10 and a plurality of terminal modules 12 inserted into the connector insulator 10. The connector insulator 10 has a plurality of L-shaped grounding terminal openings 10*a* and signal terminal openings 10*b* adjacent to the L-shaped grounding terminal openings 10*a*. The male connector 14 includes a plurality of L-shaped grounding terminal 14*a* corresponding to the grounding terminal openings 10*a* and a plurality of post-shaped signal terminals 14*b* corresponding to the signal terminal openings 10*b*. When the male connector 14 is engaged with the female connector, the grounding terminals 14*a* and the signal terminals 14*b* are inserted into the grounding terminal openings 10*a* and the signal terminal openings 10*b*, respectively. Therefore, the grounding terminals 14*a* and the signal terminals 14*b* are electrically connected with grounding pins 12*c* and signal pins 12*b* of the terminal modules 12, respectively.

FIGS. 3A and 3B are schematic views showing a process for manufacturing the conventional signal pins 12*b*. As shown in FIG. 3A, the signal pins 12*b* are cut off from a metal sheet 1 along dashed lines. The space 3*d* between the dashed lines 3*a* and 3*b* is the space of the fork-shaped signal pin 12*b* to receive the signal terminal 14*b*. However, when the metal sheet 1 is cut along the dashed lines 3*a* and 3*b*, the cut edges of the signal pins 12*b* are rough. The rough cut edges results in friction when the signal terminals 14*b* glides in the space 3*d* of the signal pins 12*b*. It makes the male connector 14 can not be smoothly engaged with the female connector. FIG. 3B is an enlarged view of area 5 in FIG. 3A. Another aspect of the problem is that the signal pin 12*b* has curved contact portions 3*c* at ends thereof to clip the signal terminals 14*b*. Although cutting the metal sheet 1 does not need a high precision manufacturing process, cutting the signal pins 12*b* with the curved contact portions 3*c* still needs improvement.

SUMMARY OF THE INVENTION

A primary objective of the present invention is to provide a female connector that has smooth surfaces to allow a male connector being smoothly inserted thereinto. Another objective of the present invention is to provide a grounding pin of a female connector whose pin arms are kept open to allow a male connector being inserted thereinto.

In order to achieve the objectives set forth, a female connector according to the present invention includes a connector insulator and a plurality of terminal modules fitted into the connector insulator. The terminal module includes a plurality of strip-shaped grounding pins and fork-shaped signal pins. The connector insulator includes a plurality of U-shaped grounding terminal openings and signal terminal opening units corresponding to the grounding terminal openings and signal terminal openings, respectively.

The signal pin of the terminal module includes a twisted first pin arm and a twisted second pin arm. The first pin arm and the second pin arm respectively have smooth contact portions facing each other at front ends thereof. The first pin arm includes a raised arm portion at a central portion thereof.

The signal terminal opening unit is a rectangular solid having a pair of signal terminal openings. The signal terminal opening is a through hole to receive the fork-shaped signal pin and is provided with a raised opening bottom. The raised opening bottom includes a slope portion close to an entrance of the signal pin and a raised portion away from the entrance of the signal pin.

When the fork-shaped signal pin is inserted into the signal terminal opening, the raised arm portion of the first pin arm is forced to be raised by the slope portion. When the fork-shaped signal pin is further inserted into the signal terminal opening, the raised arm portion is rested on the raised portion, thereby keeping the first pin arm and the second pin arm open.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENT

Figure 4A:
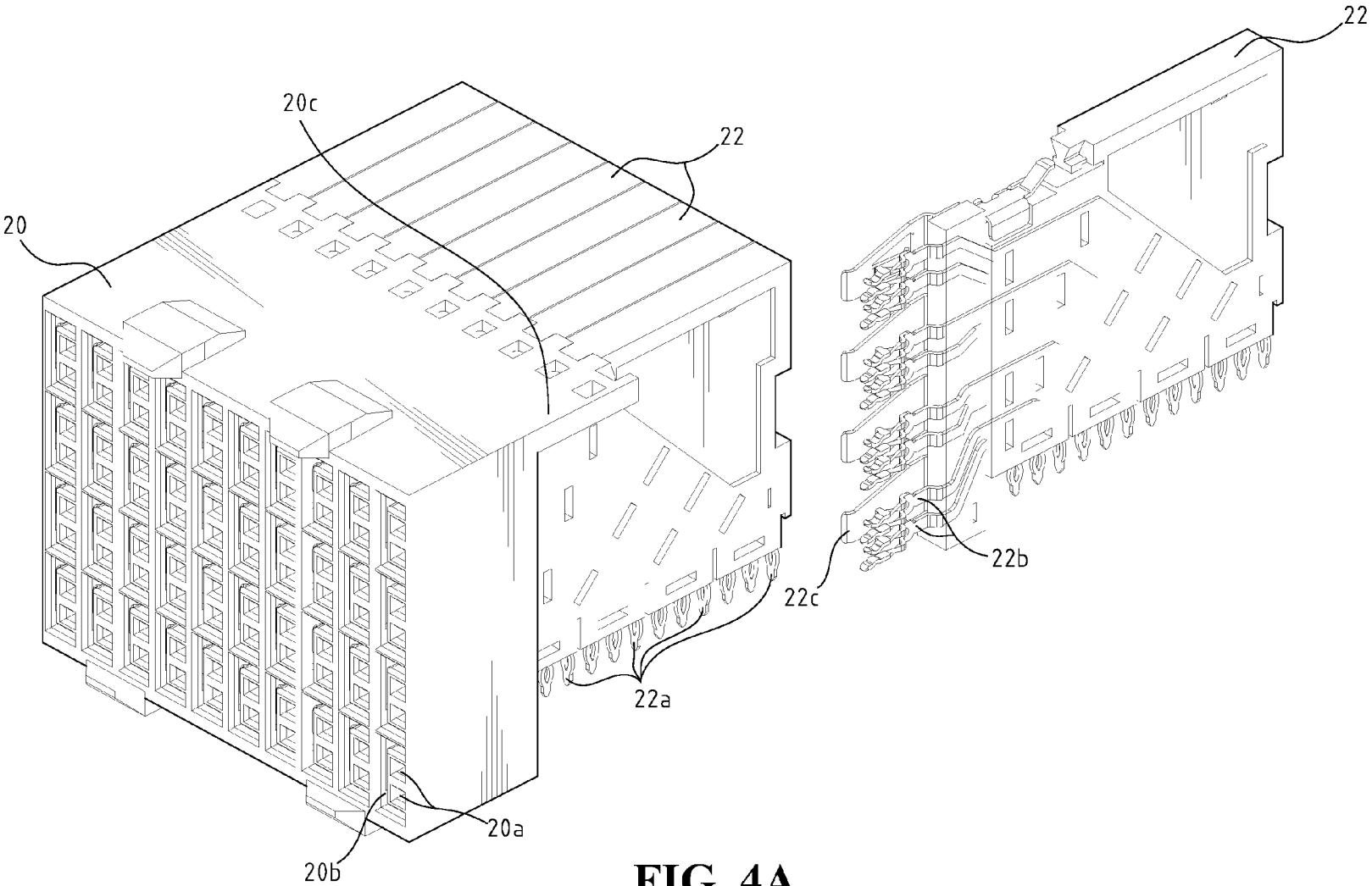
FIG. 4A is a perspective view showing a female connector according to the present invention after one of terminal modules is pulled out.

Referring to FIG. 4A, a female connector that can be smoothly engaged with a male connector 30 includes a connector insulator 20 and a plurality of terminal modules 22. The terminal module 22 includes a plurality of strip-shaped grounding pins 22*c* and fork-shaped signal pins 22*b*. Referring to FIG. 4E, the connector insulator 20 includes a plurality of signal terminal opening units 40*a* and U-shaped grounding terminal openings 20*b*. The signal terminal opening unit 40*a* has a pair of signal terminal openings 20*a*. The grounding terminal opening 20*b* surrounds the signal terminal opening unit 40*a* and receives the grounding pins 22*c* of the terminal module 22.

Figure 4B:
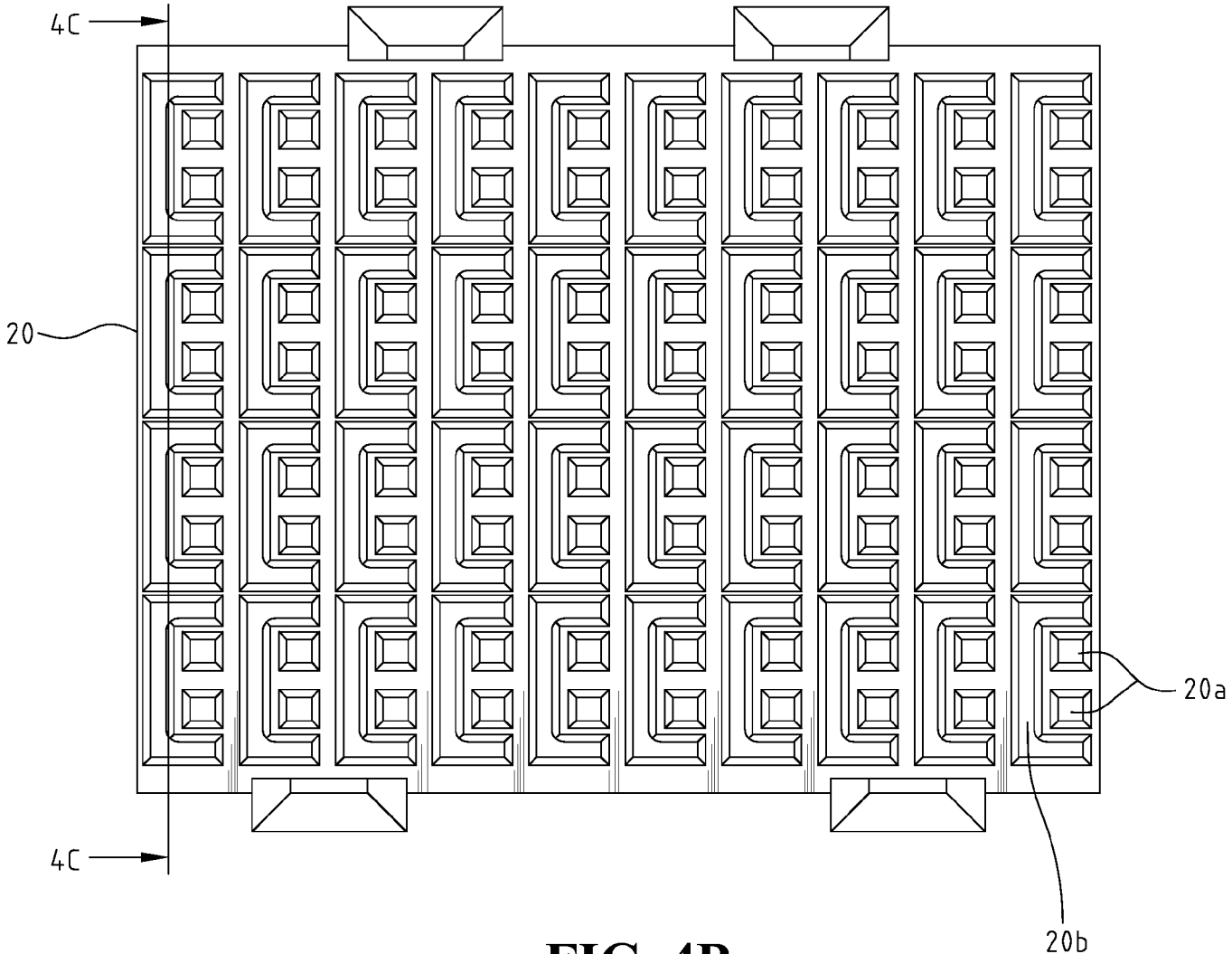
FIG. 4B is a front view showing the female connector according to the present invention.
Figure 4C:
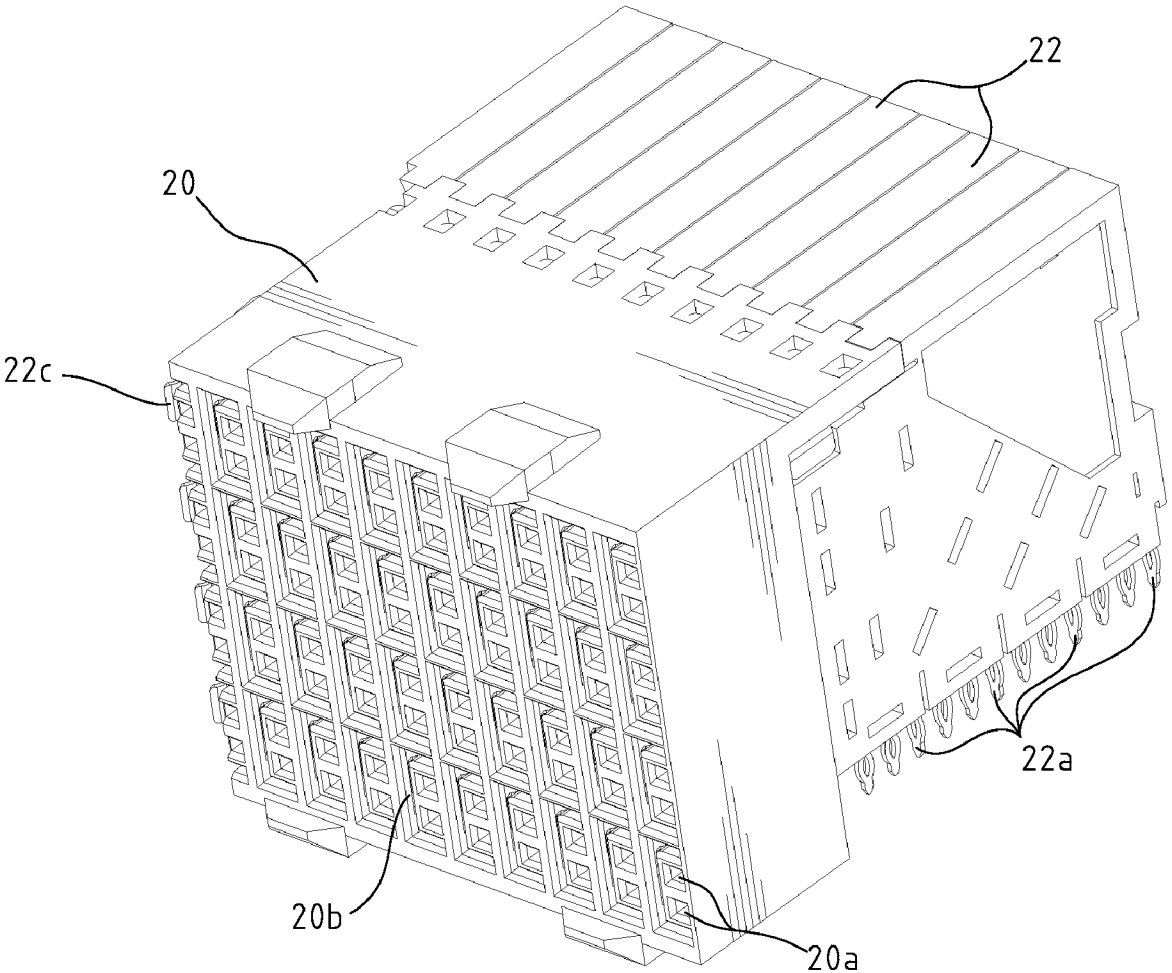
FIG. 4C is a perspective view showing the female connector of FIG. 4B after the female connector is cut off along Line 4C-4C.
Figure 4D:
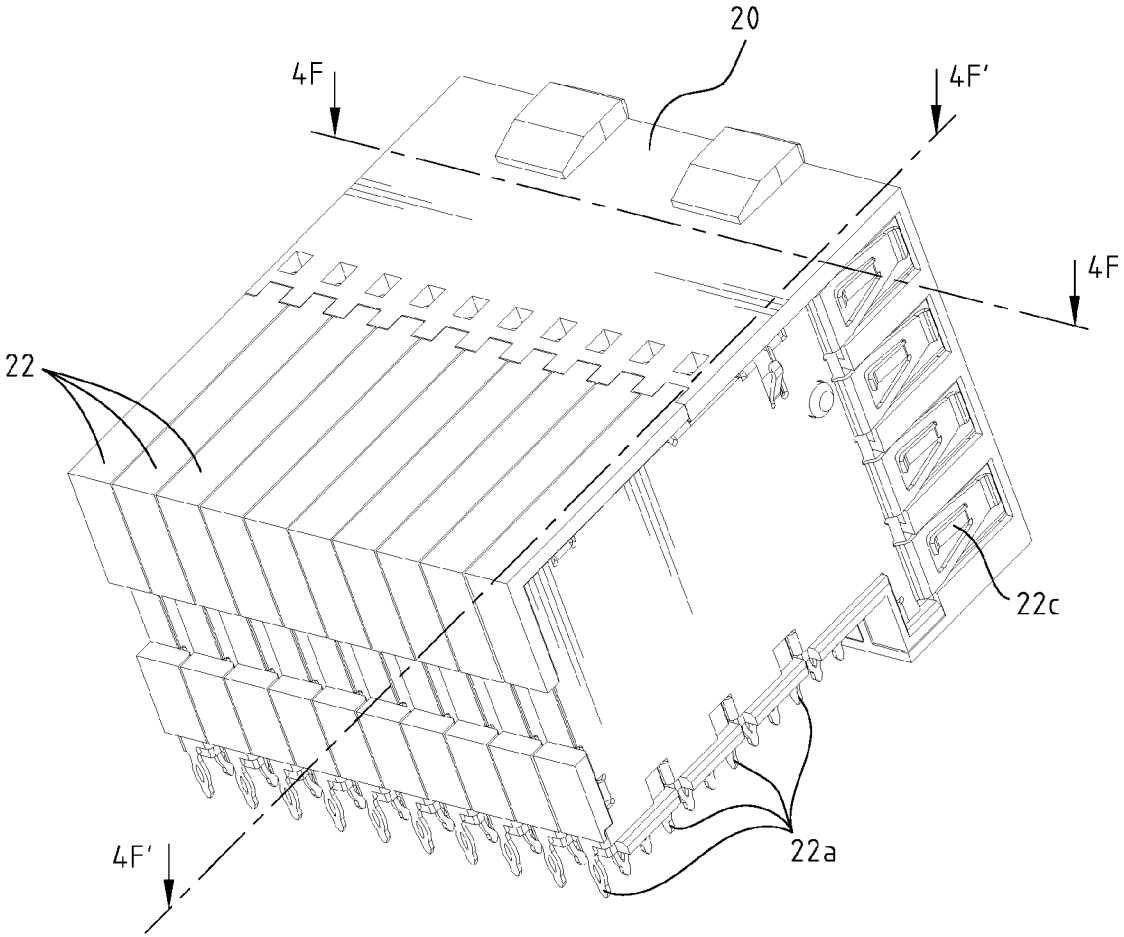
FIG. 4D is a perspective view showing the female connector of FIG. 4A viewed from another angle.
Figure 4E:
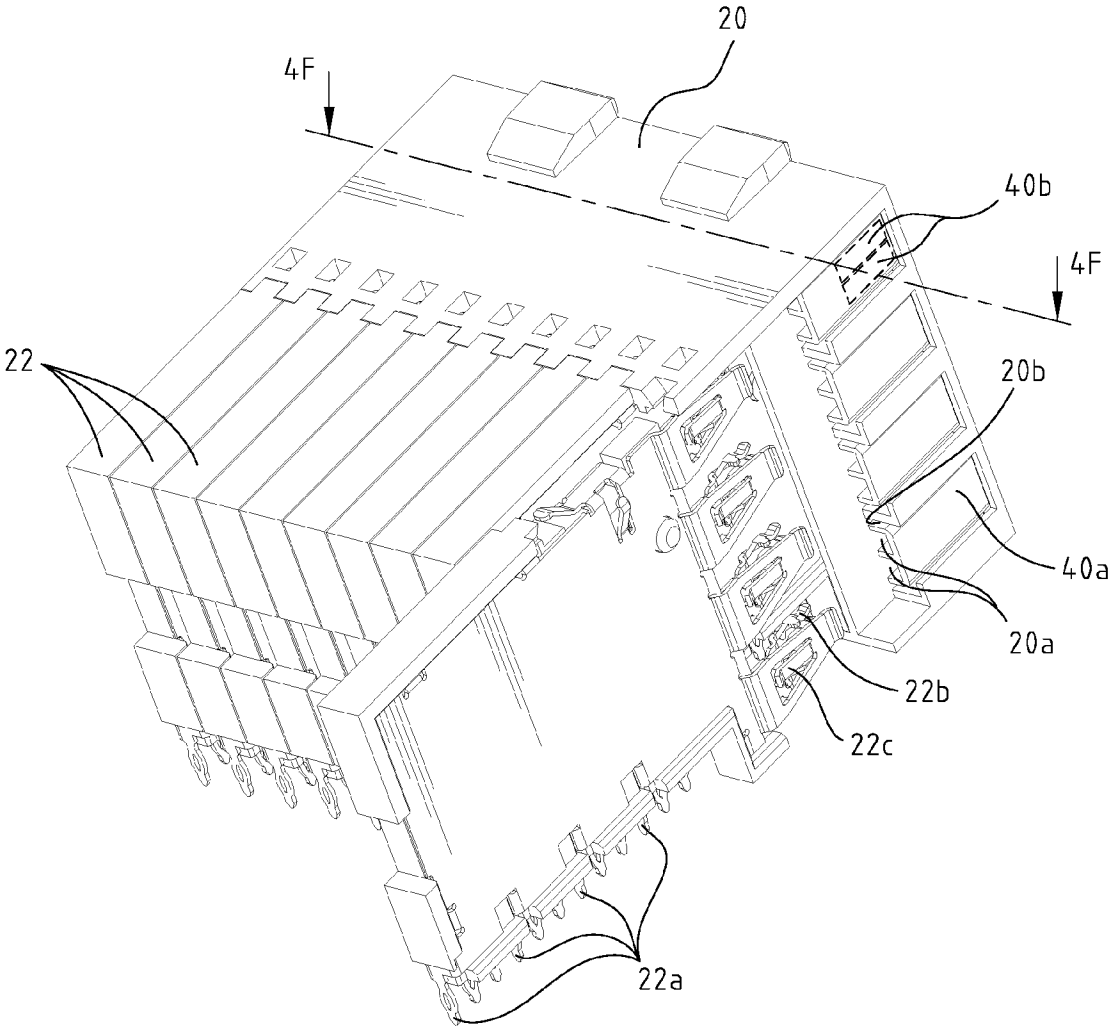
FIG. 4E is a perspective view showing the female connector of FIG. 4D after one of the terminal modules is pulled out.

FIG. 4C is the female connector of FIG. 4B after the female connector is cut off along Line 4C-4C. FIG. 4D is the female connector of FIG. 4A viewed from another angle. The grounding pins 22*c* are shown in FIGS. 4C and 4D.

FIG. 4E is a perspective view showing the female connector of FIG. 4D after one of the terminal modules is pulled out. The signal terminal openings 20*a* of the signal terminal opening units 40*a* and U-shaped grounding terminal opening 20*b* are clearly shown in FIG. 4E. The signal terminal opening 20*a* receives the signal pin 22*b*.

Figure 4F:
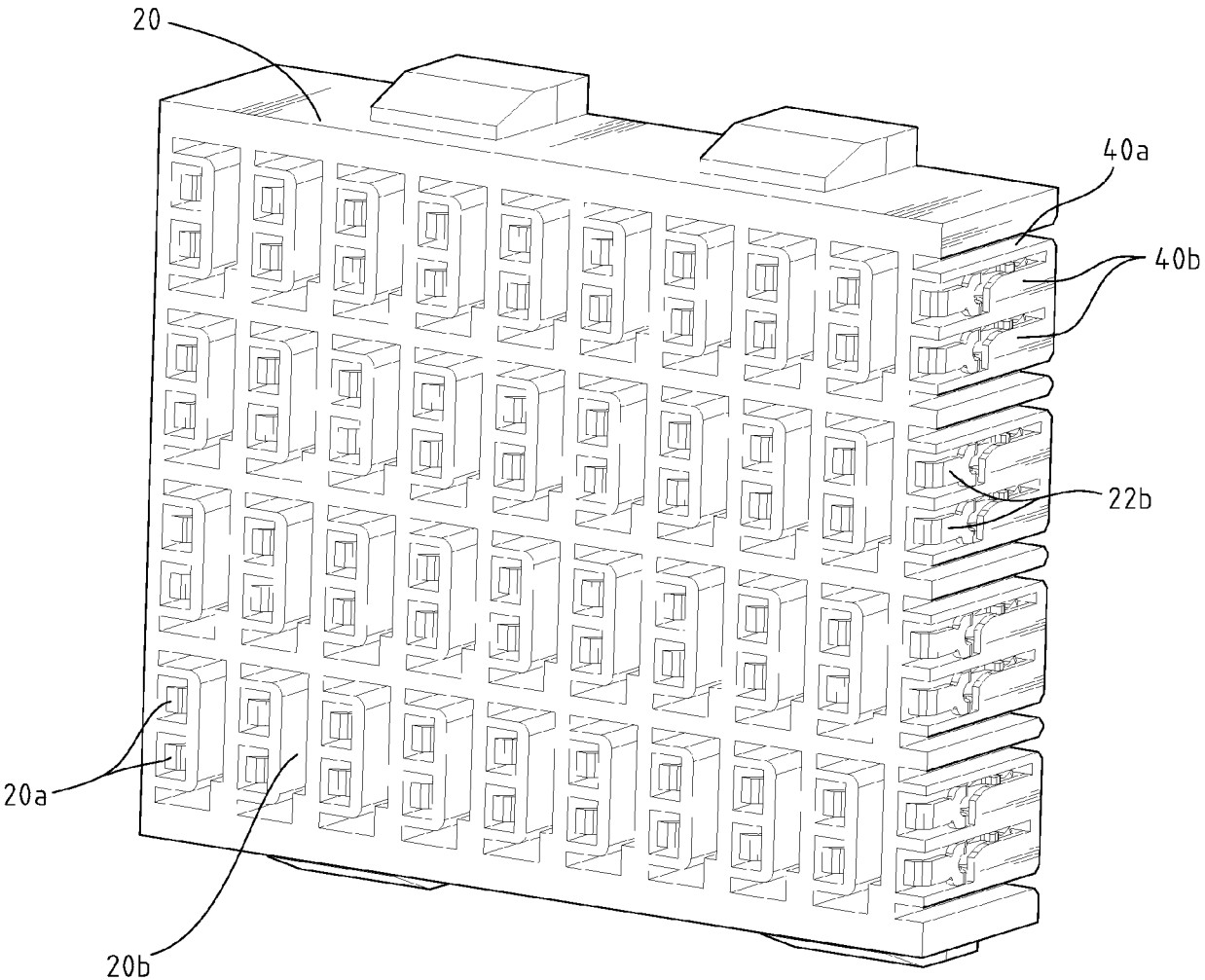
FIG. 4F is a perspective view showing the female connector of the FIG. 4D after the female connector is cut off along Lines 4F-4F and 4F'-4F'.

FIG. 4F shows the female connector of the FIG. 4D after the female connector is cut off along Lines 4F-4F and 4F'-4F'. The signal pins 22*b*, the signal terminal opening units 40*a*, the signal terminal openings 20*a* and the grounding terminal openings 20*b* are shown in FIG. 4F. The signal terminal opening 20*a* of the signal terminal opening unit 40*a* includes a raised opening bottom 40*b*.

Figure 5A:
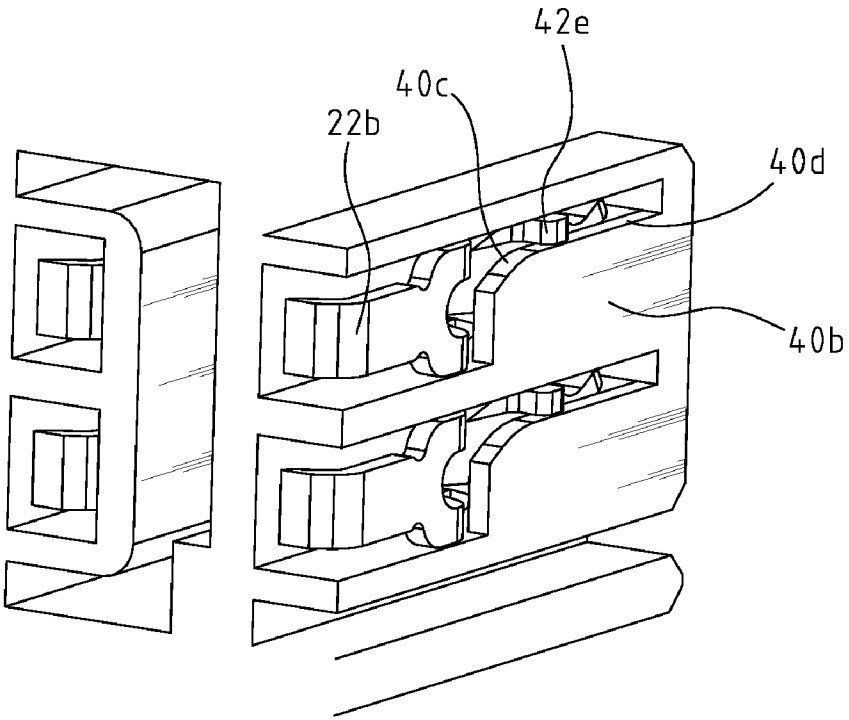
FIG. 5A is a perspective view showing signal pins according to the present invention.
Figure 5B:
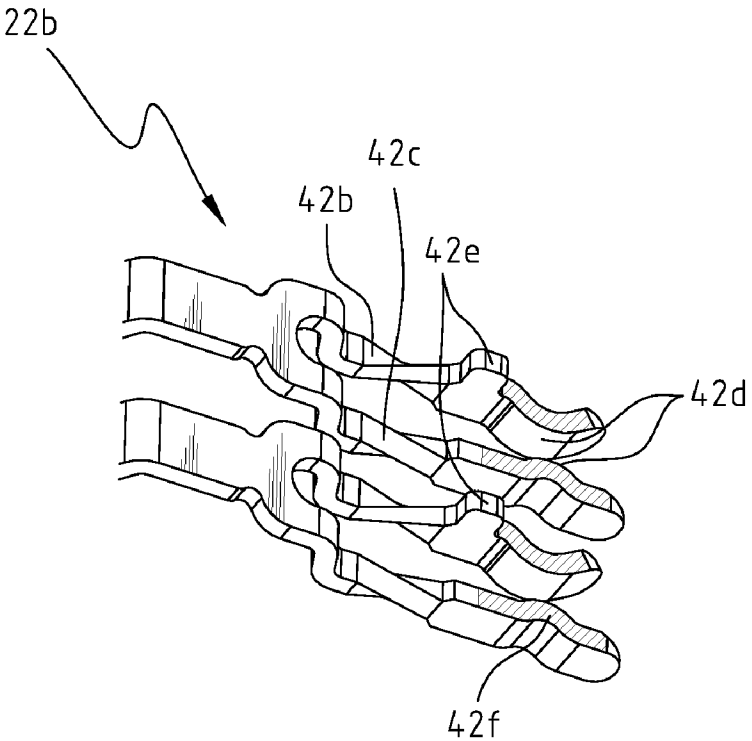
FIG. 5B is a schematic view showing a signal terminal opening unit and the engaged signal pins.

Referring to FIGS. 4F and 5A, the raised opening bottom 40*b* of the connector insulator 20 includes a slope portion 40*c* close to an entrance of the signal pin 22*b* and a raised portion 40*d* away from the entrance of the signal pin 22*b*. Referring to FIG. 5B, each of the fork-shaped signal pins 22*b* includes a twisted first pin arm 42*b* and a twisted second pin arm 42*c*. Front ends of the first pin arm 42*b* and the second pin arm 42*c* have contact portions 42*d* facing each other, respectively. The first pin arm 42*b* includes a raised arm portion 42*e* at a central portion thereof.

Figure 6:
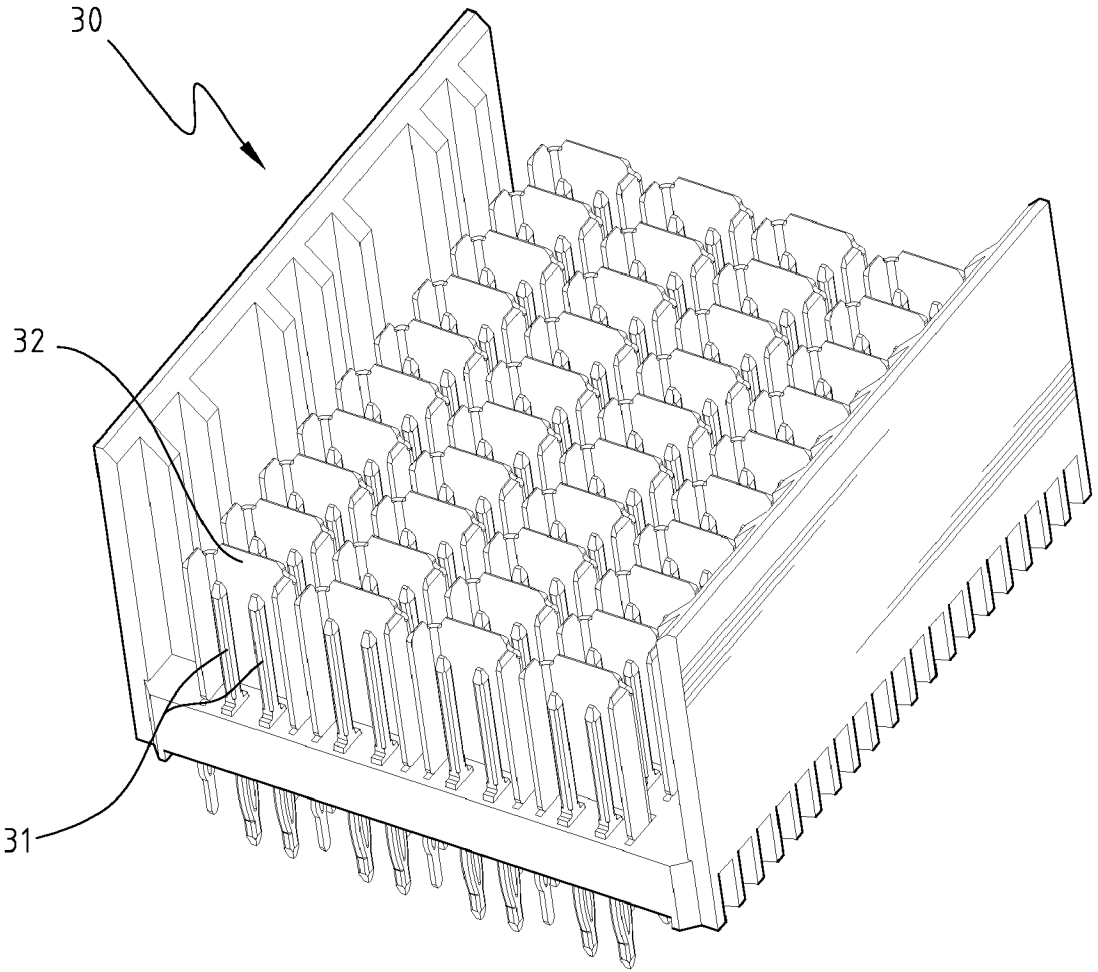
FIG. 6 is a perspective views showing a male connector corresponding to the female connector according to the present invention.

Rough surfaces 42*f* as shown in FIG. 5B are cut edges caused by cutting off the signal pins 22*b* from a metal sheet. If the first pin arm 42*b* and the second pin arm 42*c* are not twisted, the rough surfaces 42*f* will face each other and act as the contact portions. The first pin arm 42*b* and the second pin arm 42*c* according to the present invention are twisted, so the smooth surfaces from the metal sheet are twisted to face each other to provide the smooth contact portions 42*d*. The smooth contact portions 42*d* make it possible that signal terminals 31 of the male connector 30 as shown in FIG. 6 can be smoothly inserted between the first pin arm 42*b* and the second pin arm 42*c*.

Figure 1:
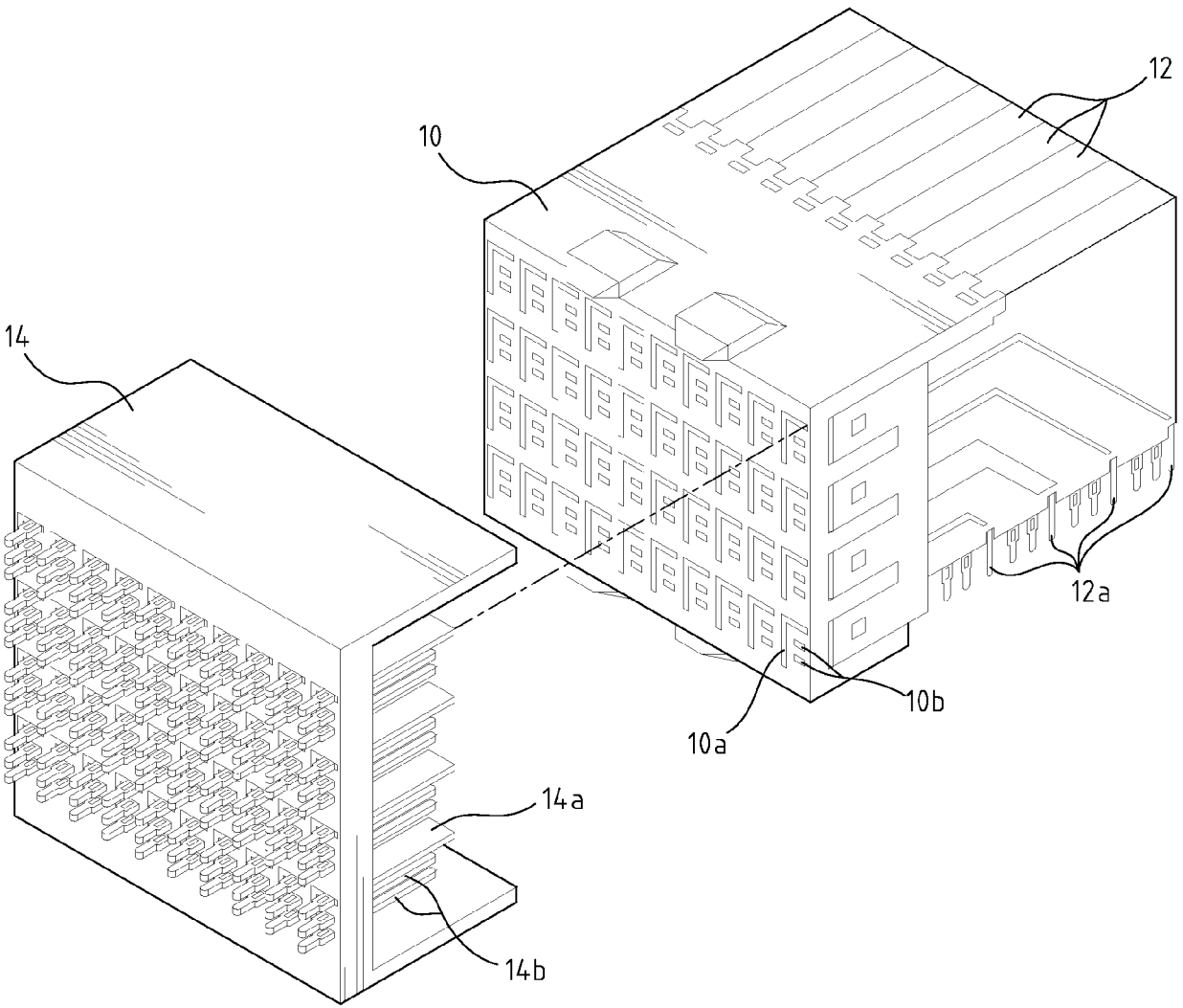
FIG. 1 ( Prior Art )
FIG. 1 is a perspective view showing a conventional electrical connector, which includes a male connector and a female connector.
Figure 2:
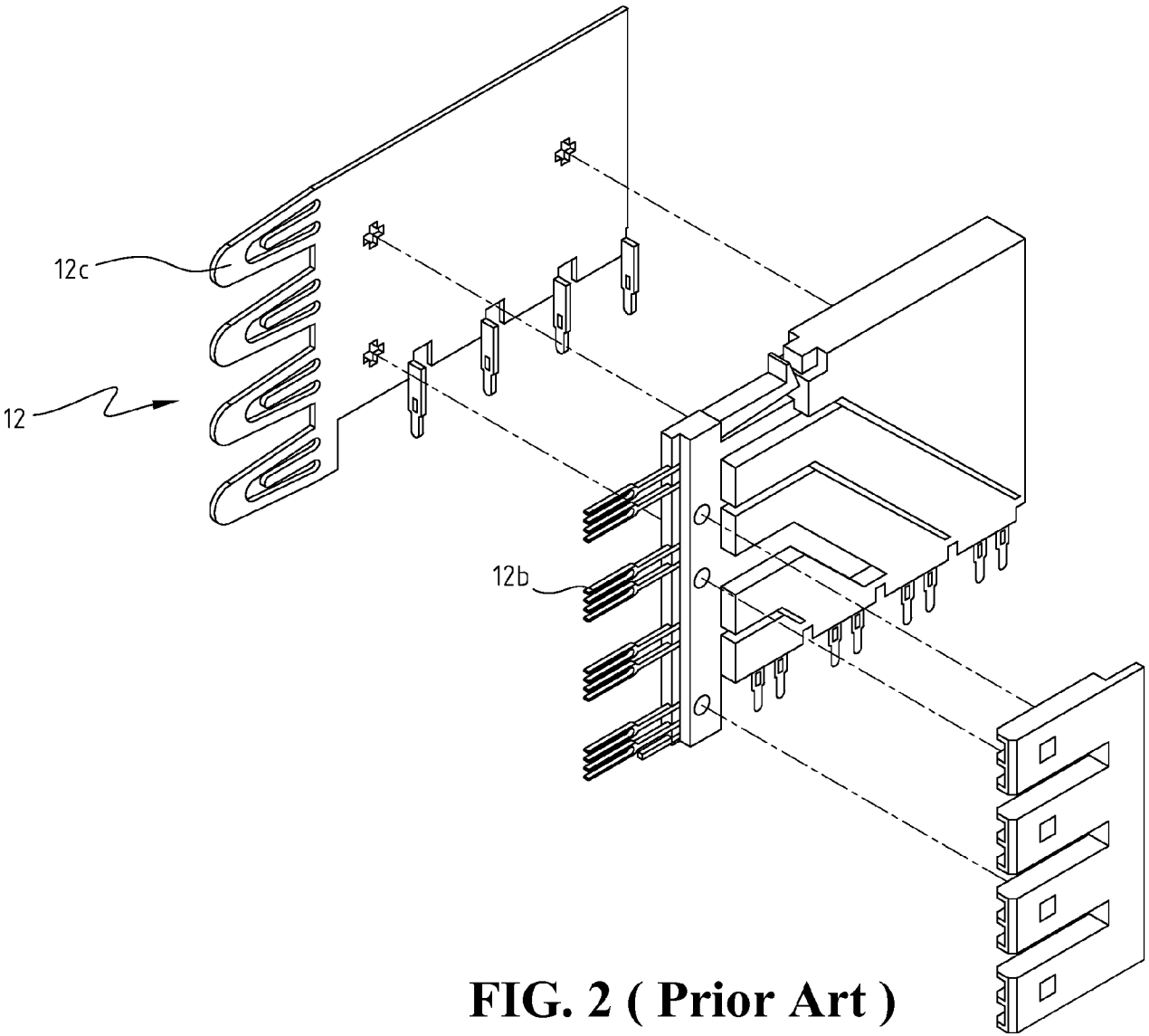
FIG. 2 ( Prior Art )
FIG. 2 is an explosive view showing a conventional terminal module of the female connector.
Figure 3B:
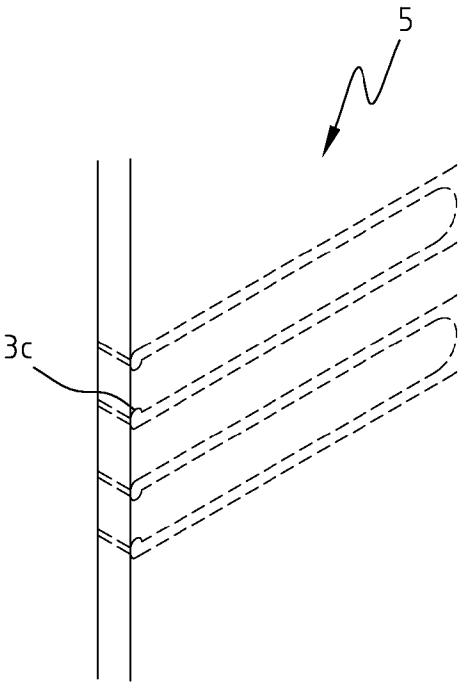
FIG. 3B ( Prior Art )
FIGS. 3A and 3B are a schematic view showing a method for manufacturing conventional signal pins of the terminal module.
Figure 3A:
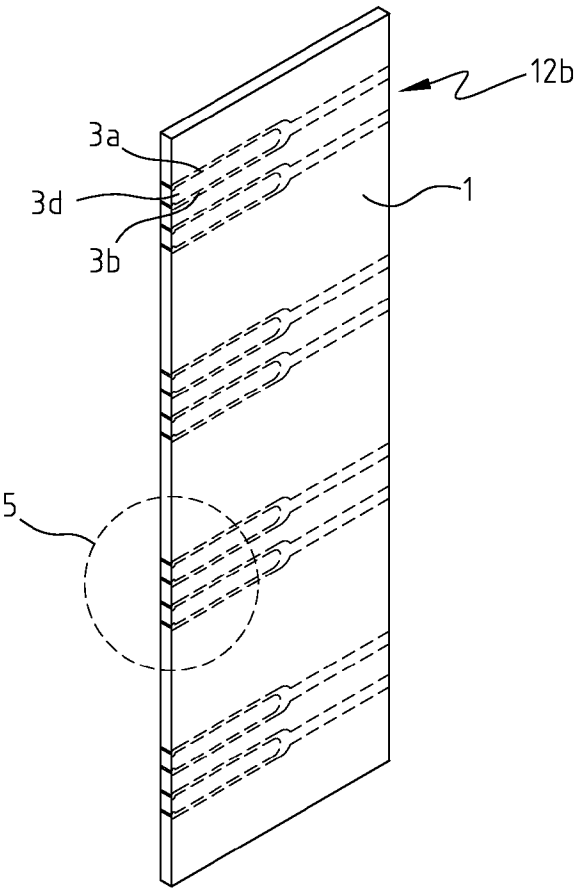
FIG. 3A ( Prior Art )

Referring to FIG. 3B, a convention signal pin 12*b* has curved contact portions 3*c* at ends thereof to clip the signal terminal. In order to provide the signal pin 22*b* according to the present invention with curved contact portions 42*d* similar to the conventional design, front ends of the first pin arm 42*b* and the second pin arm 42*c* are made to curved before twisted. After the first pin arm 42*b* and the second pin arm 42*c* are twisted, the signal pin 22*b* has curved contact portions 42*d* facing each other. Thus, the curved contact portions 42*d* can clip and electrically connect with the signal terminal 31 of the male connector 30.

Referring to FIG. 5A, the signal terminal opening 20*a* of the signal terminal opening unit 40*a* includes the raised opening bottom 40*b*. Referring to FIG. 5B, the first pin arm 42*b* includes the raised arm portion 42*e* at a central portion thereof. When the signal pin 22*b* is inserted into the signal terminal opening unit 40*a*, the raised arm portion 42*e* of the first pin arm 42*b* is forced to be raised by the slope portion 40*c* and is then rest on the raised portion 40*d*. Because the first pin arm 42*b* is raised, the first pin arm 42*b* keeps a certain distance away from the second pin arm 42*c* to receive the signal terminal 31 of the male connector 30.

The signal terminal opening 20*a* includes engaging portions (not shown in Figures) to prevent the first pin arm 42*b* and the second pin arm 42*c* from being projected out of the signal terminal opening 20*a*. When the signal terminal 31 of the male connector 30 is inserted into the signal terminal opening 20*a*, the signal terminal 31 is clip by the curved contact portions 42*d*. When the signal terminal 31 is pull out of the signal terminal opening 20*a*, a friction force is applied on the curved contact portions 42*d* to drag the signal pin 22*b* out of the signal terminal opening 20*a*. Because the pin arms 42*b* and 42*c* are blocked by the engaging portions, it is likely that the friction force will deform the pin arms 42*b* and 42*c*. In some situations, deformation may result in damage. The first pin arm 42*b* according to the present invention keeps a distance away from the second pin arm 42*c*, and therefore it is easier to pull the signal terminal 31 out of the signal terminal opening 20*a* than the conventional design. Thus, the raised first pin arm 42*b* according to the present invention prevents the signal pin 22*b* from damage.

Referring to FIG. 6, the male connector 30 includes U-shaped grounding terminals 32 and the post-shaped signal terminals 31 corresponding to the grounding terminal openings 20*b* and the signal terminal openings 20*a*, respectively. When the male connector 30 is engaged with the female connector according to the present invention, the signal terminals 31 and the grounding terminals 32 are inserted into the signal terminal openings 20*a* and the grounding terminal openings 20*b* of the female connector, respectively. Then, the signal terminals 31 are contacted with the contact portions 42*d* of the pin arms 42*b* and 42*c*, and are electrically connected with the signal pins 22*b*. The grounding terminals 32 are electrically connected with the grounding pins 22*c*. Therefore, electromagnetic interference is directed through the grounding ends 22*a* and is removed.

Although the present invention has been described with reference to the preferred embodiment thereof, it is apparent to those skilled in the art that a variety of modifications and changes may be made without departing from the scope of the present invention which is intended to be defined by the appended claims.

What is claimed is:

1. A female connector that is easy to be engaged with a male connector, comprising:

a plurality of terminal modules, each of the terminal modules comprising:

a plurality of strip-shaped grounding pins; and a plurality of forked shaped signal pins, each of the signal pins comprising a twisted first pin arm and a twisted second pin arm, front ends of the first pin arm and the second pin arm comprising contact portions facing each other, the first pin arm comprising a raised arm portion at a central portion thereof, and a connector insulator comprising:

a plurality of signal terminal opening units, each of the signal terminal opening units comprising two signal terminal openings, the signal terminal opening receiving the fork-shaped signal pin and comprising a raised opening bottom, the raised opening bottom having a slope portion close to an entrance of the signal pin and a raised portion away from the entrance of the signal pin;

wherein the first pin arm is raised by the slope portion and is rested on the raised portion to keep a distance away from the second pin arm when the signal pin is inserted into the signal terminal opening.

2. A female connector as claimed in claim 1, wherein the connector insulator comprises a first side to allow the terminal modules to be inserted thereinto and a second side having a plurality of U-shaped grounding terminal openings to receive U-shaped grounding terminals of a male connector, the grounding terminals are electrically connected with the grounding pins of the terminal modules after the grounding terminals are inserted into the grounding terminal openings.

3. A female connector as claimed in claim 1, wherein the connector insulator comprises a first side to allow the terminal modules to be inserted thereinto and a second side having the signal terminal openings to receive signal terminals of a male connector, the signal terminals are electrically connected with the contact portions of the first pin arms and the second pin arms after the signal terminals are inserted into the signal terminal openings.

* * * * *